United States Patent [19]

Yasui et al.

[11] 4,426,840

[45] Jan. 24, 1984

[54] OPEN-END SPINNING MACHINE

[75] Inventors: Yoshiharu Yasui, Kariya; Keiji Onoue, Toyota; Kozo Motobayashi, Aza-Nodamachi; Toshio Yoshizawa, Chiryu, all of Japan

[73] Assignee: Kabushi Kaisha Toyoda Jidoshokki Seisakusho, Aichi, Japan

[21] Appl. No.: 333,918

[22] Filed: Dec. 23, 1981

[30] Foreign Application Priority Data

Dec. 29, 1980 [JP] Japan ..... 55-185344

[51] Int. Cl.[3] ..... D01H 1/135; D01H 7/888; D01H 13/14

[52] U.S. Cl. ..... 57/301; 57/408; 57/411

[58] Field of Search ..... 57/301, 304, 408, 411, 57/265

[56] References Cited

U.S. PATENT DOCUMENTS 3,696,605 10/1972 Morikawa et al. ..... 57/301 X
3,800,521 4/1974 Doudlebsky et al. ..... 57/301
3,922,839 12/1975 Sakurai et al. ..... 57/301 X
3,926,665 12/1975 Harrap et al. ..... 57/301 X
4,150,533 4/1979 Gusser et al. ..... 57/265

*Primary Examiner*—Donald Watkins
*Attorney, Agent, or Firm*—Burgess, Ryan & Wayne

[57] ABSTRACT

An open-end spinning machine having a plurality of spinning units (5) arranged side by side in a row extending in the longitudinal direction of the spinning machine. Each of the spinning units (5) has a filter (11) disposed at the front surface thereof and extending for substantially the entire width thereof. All the filters (11) arranged on the spinning units (5) disposed at one side of the spinning machine lie on a substantially identical imaginary plane slightly upwardly inclined from a horizontal plane when seen from the front to the rear. Each spinning unit includes a duct means (13) having air passages (15, 23, 27, 31) extending from the openings (**13*a*, 13*b*, 13*c*, 13*d*) located adjacent to the filter (11) to the upper surface of a feeding roller (25), the upper and lower surfaces of a combing roller (21), and the periphery of the combing roller (21**).

10 Claims, 12 Drawing Figures

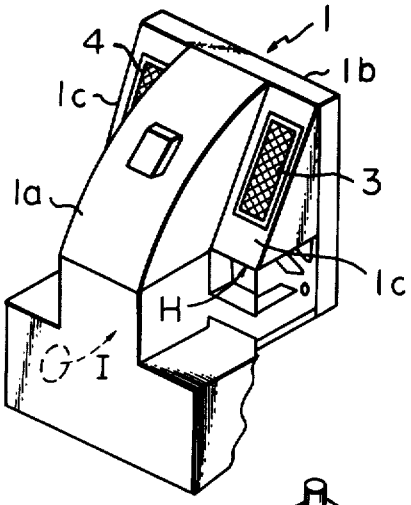
Fig. 1
PRIOR ART
Fig. 2
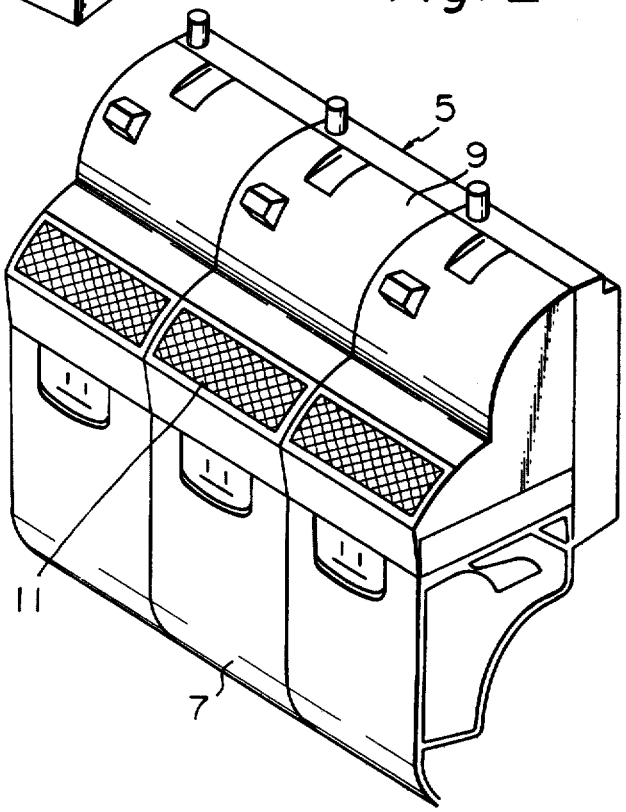

Fig. 3
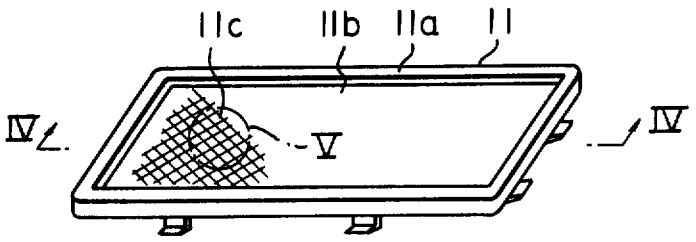
Fig. 4
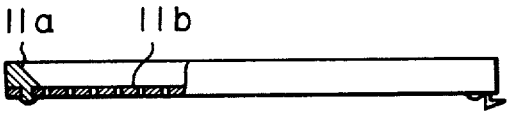
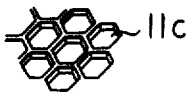
Fig. 5

OPEN-END SPINNING MACHINE

TECHNICAL FIELD TO WHICH THE INVENTION RELATES

This invention relates to an open-end spinning machine having a plurality of spinning unit means arranged side by side in the longitudinal direction of said machine.

PRIOR ART OF THE INVENTION

As is apparent from the fact that open-end spinning machines are also known as pneumatic spinning machines, open-end spinning machines utilize large amounts of air during operation, such as the following air:

(1) Air blowing against the upper surface of the feed rollers, feeding slivers to combing rollers, so as to prevent the deposition of floating fibers upon the upper surface of the feed rollers;

(2) Air blowing against the upper and lower surfaces of a combing rollers, combing the fed slivers, so as to prevent deposition of floating fibers upon the upper and lower surfaces of the combing rollers;

(3) Air supplied to channels extending from the peripheral surface of combing rollers to the inside of spinning rotors so as to deliver the fibers combed by the combing rollers to the inside of the spinning rotors;

(4) Air for removing dust centrifugally removed from slivers by means of the rotation of the combing rollers;

(5) Air for delivering the removed dust to dust removing ducts;

(6) Auxiliary air for returning to the slivers the effective fibers occasionally separated from the slivers in dust removing devices. Note that this auxiliary air merges with the air described in item (3) after it passes through the opening of the dust removing devices.

In conventional spinning units, the air described in items (1) through (3) above (only the air blowing against upper surface of combing rollers for item (2)) is introduced from the spinning room wherein the open-end spinning machines are installed through a plurality of individual filters arranged toward the rear of the spinning units, after which the filtered air is supplied to the various portions corresponding to the individual filters.

However, since the filters are disposed toward the rear of the spinning units, it is not easy to observe them from the front. Accordingly, it is very difficult for operators to check whether the filters are clogged with floating fibers. When operators find filters clogged with floating fibers, they also have trouble cleaning the filters because they must extend their arms in toward the rear of the spinning units.

Furthermore, it must be pointed out that air inlets for the air described in items (6) and part of the air described in item (3) i.e., the air blowing against the lower surface of the combing rollers, are located at positions lower than the above-mentioned filters and introduce unfiltered air to the spinning units. The inventors of the present invention have found that such unfiltered air causes irregular yarns, yarn breakage, and clogging of floating yarns in various portions of the spinning units.

Even filtered air may contain impurities, such as short fibers and dust, which may clog the inlets of fiber supply channels and the air passages extending to the upper surface of feed rollers and the upper surface of combing follers. As a result, deposition of short fibers and dust may occur at various portions in the spinning units. Deposition of short fibers and dust especially easily occur at trash exhausting openings and the lower surface of combing rollers where unfiltered air is supplied.

Deposition of short fibers and dust around fibrous material opening means may cause various problems in the production of open-end spun yarns and the administration of the spinning units. For example, in the worst case, floating fibers clogging the gaps located near the upper or lower surface of the combing rollers may stop the rotation of the combing rollers.

Even not so severe clogging of floating fibers may cause yarn breakage or irregular yarns when deposited floating fibers clump together and enter the spinning rotors. Deposited floating fibers further may become dark after a certain period of contact with the aluminum body of the spinning units. Such deposited floating fibers may in many cases also contain dirty fibers which had floated within the spinning room. Entrance of such floating fibers into the spinning rotors for spinning will generate a black yarn, thereby significantly reducing the commercial value of the produced yarn. Deposition of floating fibers around the upper surface of feed rollers or the neighborhood of feed rollers may cause yarn breakages and slub yarns because clumps of deposited floating fibers enter spinning rotors similar to the case of combing rollers.

In some cases, a defect may occur in that floating fibers and dust clog an outlet opening of a track transporting passage. Operators have to check for such defects by naked eye from the outside of the spinning units. Failure to find such defects and leaving the spinning unit clogged would hamper the discharge of trash due to a weak or fluctuating trash-air flow.

SUMMARY OF THE INVENTION

An object of the present invention is to provide an open-end spinning machine which is free from many of the difficulties in checking clogging of filters and troublesome work in cleaning filters, which difficulties and works are inherent in conventional open-end spinning machines, and in which checking and cleaning of clogging of the filter can easily and rapidly be done.

Another object of the present invention is to provide an open-end spinning machine in which the air supplied to various portions of the spinning units, passing through channels, and ending up at the spinning rotors is effectively passed through filters so as to prevent the occurrence of irregular yarns and deposition of floating fibers at the various portions, thereby reducing yarn breakage.

A further object of the present invention is to provide an open-end spinning machine which can detect at an early stage an abnormal condition concerning deposition of floating fibers and dust in air passages between a fibrous material opening device and an spinning rotor and in a trash transporting passage, thereby enabling elimination of said abnormal condition by cleaning and discharging the deposited floating fibers and dust before stoppage of the rotation of the combing roller and the occurrence of yarn breakage.

The present invention achieves the above-described objects by an open-end spinning machine having a plurality of spinning unit means arranged side by side in a row extending in the longitudinal direction of the spinning machine, characterized in that each of the spinning unit means has filtering means disposed at the front surface thereof and extending for substantially the entire width thereof, all the filtering means arranged on the spinning unit means along a row lying on a substantially identical imaginary plane.

In an embodiment of the present invention, each of the spinning unit means includes a duct means having an air inlet correspondingly formed to said filter means and a fibrous material opening means disposed therein adjacent to the duct means, the duct means having an air flow-in means, communicating with the air inlet, for supplying air to at least one predetermined portion of the fibrous material opening means.

In general, the fibrous material opening means comprises a feed roller for feeding fibrous material, a combing roller for combing the fed fibrous material, a spinning rotor for spinning the combined fibrous material, and a channel extending from the vicinity of the combing roller to the inside of the spinning rotor. It is preferable that the air flow-in means extend to the upper surface of the feed roller and the upper and lower surfaces of the combing roller. It is also preferable that the air flow-in means includes a first passage extending between the air inlet and the upper surface of the feed roller, a second passage extending between the air inlet and the upper surface of the combing roller, a third passage extending between the air inlet and the lower surface of the combing roller, and a fourth passage extending between the air inlet and the side of the combing roller.

In a further embodiment of the present invention, a means for detecting changes in air flow passing through the air flow-in means is disposed, where the output signal of the detecting means is input to an indicating means, such as an alarm.

BRIEF DESCRIPTION OF THE DRAWINGS

The present invention will now be explained in detail with reference to the attached drawings, wherein:

FIG. 1 is a perspective view of conventional spinning units;

FIG. 2 is a perspective view of spinning units of an open-end spinning machine according to the present invention;

FIG. 3 is a perspective view of a filter utilized in an embodiment of the present invention;

FIG. 4 is a cross-sectional view taken along line IV—IV in FIG. 3;

FIG. 5 is an enlarged perspective view of portion V in FIG. 3;

PREFERRED EMBODIMENT FOR CARRYING OUT THE INVENTION

Figure 6:
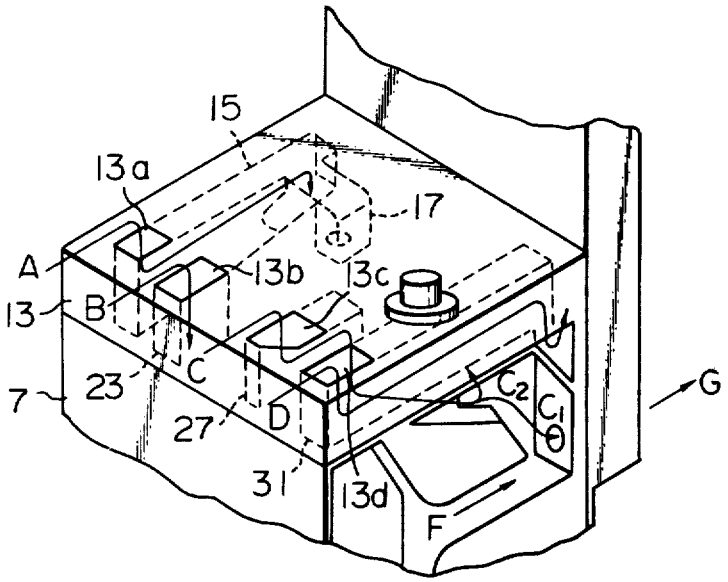
FIG. 6 is a perspective view of a spinning unit illustrated in FIG. 2 in a condition wherein a cover is removed.

Prior to the explanation of the present invention, a typical conventional open-end spinning machine will first be explained with reference to FIG. 1, illustrating typical spinning units 1 utilized in conventional spinning machine. The central portion 1*a* of the spinning unit 1 bulges out considerably from the rear surface 1*b*, while the side portions 1*c* located at both the sides of the bulged central portion 1*a* slightly project from the rear surface 1*b* like triangular prisms. The projecting portions 1*c* forming triangular prisms have filters 3 and 4 arranged at the surfaces thereof to remove the fibers floating in the spinning room in which the spinning machines are installed and thereby enable the supply of filter air to the upper surface of the feed roller, the upper surface of the combing roller, and the channel extending between the side of the combing roller and the spinning rotor (not shown).

In the conventional spinning unit 1, since the filters 3 and 4 are located at the innermost positions far from the surface of the central portion 1*a*, an operator cannot easily check for clogging of the filters 3 and 4 during piercing or doffing operations. In addition, when the operator finds that the filter 3 or 4 is clogged, he must extend his arm from the front to the rear of the spinning unit to clean the filter 3 or 4. Furthermore, since the filters 3 and 4 are separated from each other by the central portion 1*a*, the operator has to extend his arm twice for each spinning unit, which operation is somewhat troublesome.

Further, conventional spinning units utilize air which has not been filtered by means of filters 3 and 4 for dust removal and for preventing deposition of floating fibers on the lower surface of the combing rollers. There occurs yarn breakage or slub yarns caused by contamination by floating fibers contained in the dust-removing air because part of the dust-removing air is supplied to the channel, after passing the neighborhood of the combing rollers, and reaches the spinning rotor. In addition, deposition of floating fibers on the surface of the dust removing aperture or on the lower surface of the combing rollers may cause yarn breakage or slub yarns. It should be noted that the phenomenon that dust-removing air containing floating fibers may enter the spinning rotor after passing by the vicinity of the combing rollers has not been fully recognized. It is also very difficult to add another filter so as to filter and clean the dust-removing air due to structural matters, especially the installation space of the filters.

The present invention will now be explained. As illustrated in FIG. 2, a plurality of spinning units 5 according to the present invention are arranged side by side in a row in a longitudinal direction of the spinning machine. The spinning unit 5 comprises a body 7, i.e., a fibrous material opening device, and a cover 9 mounted on the body 7. The cover 9 has a filter 11 at a position located at the front of the spinning unit 5. The filter 11 extends for substantially the entire width of the spinning unit 5. The filters 11 of a plurality of spinning units 5 arranged along the above-mentioned row lie on a substantially identical imaginary plane slightly inclined upward from the horizontal plane seen from the front to the rear of the spinning unit 5, so that the filters face an operator standing in front of the spinning units. The construction of the filters 11 is not specially limited so long as it is of a gauge allowing removal of fibers floating in the spinning room and so long as the ratio of the apertured area to the whole filter area is about 60%. An example of a filter 11 preferable to the present invention will now be explained in reference to FIGS. 3 through 5. In FIGS. 3 and 4, the filter 11 comprises a frame 11*a* made of plastic and thin filter member 11*b* made of plastic and thermally welded to the frame 11*a*. The filter member 11*b* has a plurality of small, hexagonal apertures 11*c* (see FIG. 5).

Figure 7:
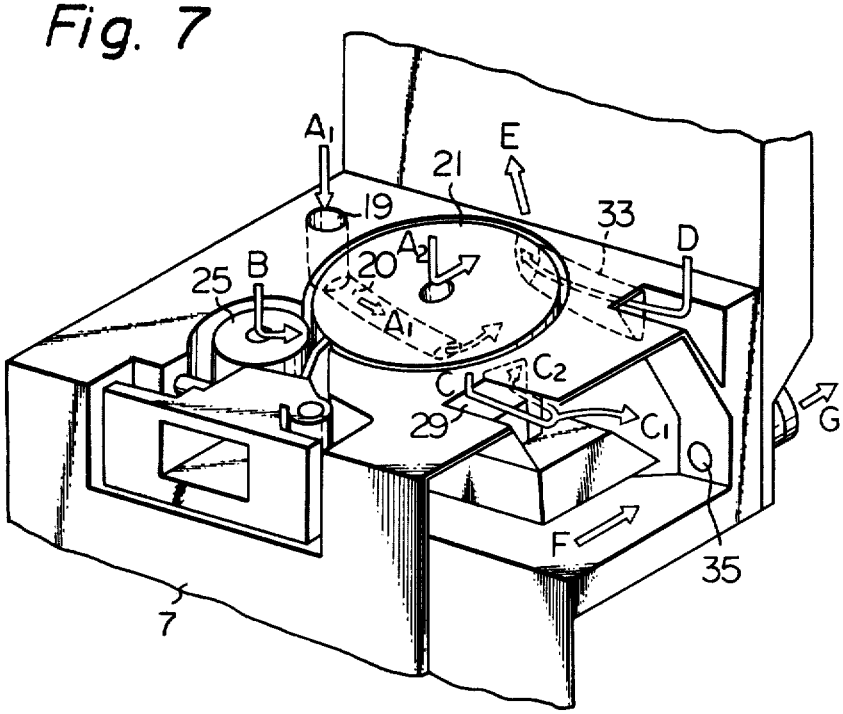
FIG. 7 is a perspective view of the spinning unit illustrated in FIG. 6 in another condition wherein a duct means is also removed.

FIG. 6 illustrates the construction of a duct means which is utilized to supply air to various portions of the body, as seen by removing the cover from one of the spinning units illustrated in FIG. 2, and FIG. 7 illustrates the upper portion of the body 7 as seen by further removing the duct means 13 illustrated in FIG. 6.

Figure 8:
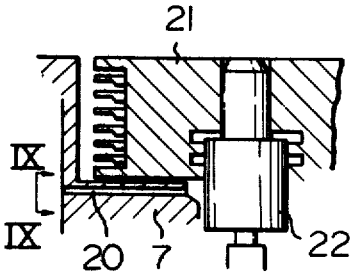
FIG. 8 is a cross-sectional view of a combing roller utilized in an embodiment of the present invention.
Figure 9:
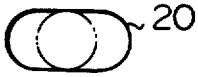
FIG. 9 is an enlarged view taken along line IX—IX in FIG. 8.

An opening 13*a* formed at the upper surface of the duct means 13, as shown in FIG. 6, communicates with an air passage 19 via an air passage 15 and opens at the lower surface of a combing roller 21 via an air passage 20 as shown in FIG. 7. Accordingly, air A filtered by the filter 11 illustrated in FIG. 2 flows into the opening 13*a* illustrated in FIG. 6 and blows against the lower surface of the combing roller 21 as an air flow $A_1$ through the air passage 15 and the air passage 19 and 20 illustrated in FIG. 7, so as to prevent deposition of floating fibers upon the lower surface of the combing roller 21. As illustrated in FIG. 9, the air passage 20 utilized in this embodiment is different from a conventional one, illustrated in a phantom line, in its cross-sectional shape, which is a horizontally extended ellipse. Accordingly, air flowing into the air passage 20 from the left to the right in FIG. 8 is dispersed over the portion between the spindle 22 and the bottom surface of the combing roller 21 to effectively prevent the deposition of floating fibers on the bottom surface.

Referring to FIG. 6 again, an air passage branched from the air passage 15 opens at the upper surface of the combing roller 21 (FIG. 7), and air A passing through the filter 11 (FIG. 2) flows through the air passages 15 and 17 (FIG. 6) and blows against the upper surface of the combing roller 21 as an air flow $A_2$ (FIG. 7) so as to prevent floating fibers from deposition on the combing roller 21.

The opening 13*b* illustrated in FIG. 6 opens at the upper surface of a feed roller 25 illustrated in FIG. 7 via an air passage 23. As a result, air flowing in through the filter 11 (FIG. 2) blows against the upper surface of the feed roller 25 as an air flow B after it passes through the opening 13*b* and the air passage 23, thereby preventing floating fibers from depositing on the surface.

Air from an opening 13*c* (FIG. 6) flows through an air passage 27 and then blows out from an opening 29 formed at the side of the combing roller 21 as an air flow C which serves to remove dust from fibers combed by means of the combing roller 21. According to previous knowledge, the entire air flow C changes into an air flow $C_1$ containing dust and is discharged together with dust-transporting air flow F supplied without being filtered from a discharge opening 35 to the dust collecting duct (not shown) as an air flow G. However, the inventors of the present invention have found from considerable research that part of the dust-removing air C, which is illustrated as $C_2$ in FIG. 7, may recirculate toward the combing roller 21, and that if the supplied dust-removing air C contains floating fibers, the produced yarn may break or become an irregular yarn, such as a slub yarn. Based on the above-described recent knowledge, unlike conventional devices, the present invention utilizes air from which fibers floating in the spinning room are filtered by the filter 11 (FIG. 2) as dust-removing air. Since the dust transporting air flow F is practically free from such a problem, the present invention utilizes air taken from the spinning room without filtering just as with conventional devices.

An opening 13*d* communicates with a channel 33 extending from the peripheral portion of the combing rollers 21 to the inside of a spinning rotor (not shown) via an air passage 31 (FIG. 6), and an air flow D filtered by the filter 11 (FIG. 2) delivers fibers combed by the combing roller 21 to the inside of the spinning rotor.

Based on their other research, the present inventors have also found that there is a difference in air flow between (1) the normal condition wherein there are no fibers or dust deposits in the air passages extending from the air inlet, i.e., the filter 11, of the spinning unit to the discharge duct of the spinning rotor and in the air passages extending from the air inlet to the dust discharging opening and (2) an abnormal condition wherein there are fibers or dust deposits in the above-mentioned air passages. More specifically, clogging of a part of the air passages has an effect on other air passages. According to an embodiment of the present invention, defects in spinning units are detected by the changes in the air flow.

A detecting means for detecting the changes in air flow can be disposed at appropriate positions in the air passages, preferably in the air passage between the air inlet and the fibrous material opening means so as to detect the changes in the air flow passing there.

Figure 10:
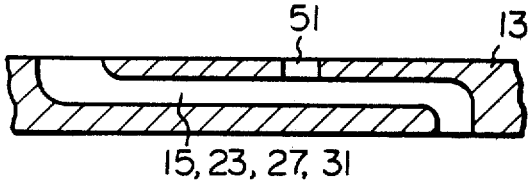
FIG. 10 is a cross-sectional view illustrating the installation within an air passage of a means for detecting changes in air flow according to the present invention.

As illustrated in FIG. 10, at least one of the air passages 15, 23, 27, and 31 formed in the duct means 13 has a detecting means 51. It is preferable that all the passages have the detecting means 51, allowing the changes in the air flow to be detected more precisely.

The detecting means can be a conventionally known type for detecting such changes in the air flow as air flow speed, air flow rates, or static pressures. A conventionally known hot-wire anemometer can also be used as a detecting means.

Figure 11:
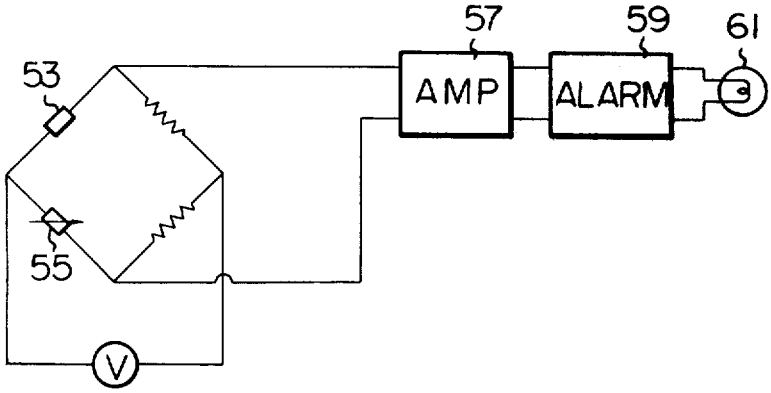
FIG. 11 is a circuit of an embodiment of the detecting means of the present invention.
Figure 12:
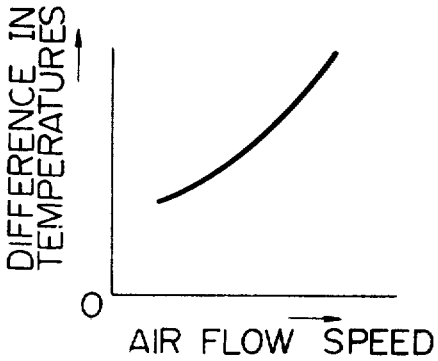
FIG. 12 is a diagram illustrating the relationship between air flow speed and difference in temperatures.

FIG. 11 illustrates an embodiment of the detecting means 51, wherein changes in air flow speed, i.e., air flow rate, is detected by means of a conventional temperature detecting sensor 53, such as a thermocouple or thermister. A temperature detecting sensor 53 is disposed in the wall of the air passage, as illustrated in FIG. 10, and a sensor 55 for compensating for environmental temperature variation is disposed at a position where there is no air flow. There is a correlative relationship, illustrated in FIG. 12, between air flow speeds and differences in temperatures of the sensors. The temperature detecting sensor 53 disposed in the air passage and the environmental temperature variation compensating sensor 55 are used as components of a bridge circuit. As a result, if the difference in the temperatures detected by both the temperature detecting sensors 53 and 55 is constant, no voltage signal is created. However, if the balance of the bridge circuit is lost, a voltage signal is created. After the voltage signal is amplified by means of an amplifier 57, the output is applied to an appropriate alarm 59, for indicating the occurrence of an abnormal condition by lighting a lamp 61 or by sounding a buzzer (not shown), or to a central control center.

As illustrated in FIG. 2, the spinning unit of the present invention has the filter 11 at the front surface thereof, and accordingly, an operator can easily check whether or not the filter 11 is clogged while he is conducting a yarn piecing, bobbin doffing, or threading operation. An operator can check for clogging of the filters 11 of the spinning units 5 by merely walking in front of the open-end spinning machine thereby being able to perform the check without difficulty.

In addition, since the filter 11 extends over substantially the entire width of each spinning unit 5, and since the filters 11 of a plurality of the spinning units 5 lie on a substantially identical plane, filters 11 substantially continue from one end to the other end of the spinning frame in the longitudinal direction thereof. Accordingly, if one presses a duster gently against the filter 11 of the spinning unit located at one end and then moves along the spinning machine to the other end, one can readily and rapidly clean all the filters of all the spinning units 5. The cleaning operation is considerably facilitated because the filters 11 are disposed at the front surfaces of the spinning units 5. Since the cleaning operation can be achieved by gently pressing the duster or a brush against the filter and moving in one direction, the cleaning operation can easily be automated.

According to an embodiment of the present invention, almost all the air supplied to the various portions of the spinning units, especially air finally reaching the spinning rotor through the channel, is reliably introduced through the filter 11 and then supplied to the predetermined portions through the duct means. As a result, inconveniences involved in the conventional spinning units can be eliminated, and practical advantages, such as the prevention of irregular yarn, the reduction of yarn breakage, and the prevention of deposition of floating fibers on various portions of the spinning unit can be achieved.

In addition, each spinning unit of the present invention has a single, streamlined filter as illustrated in FIG. 2, thereby allowing a greater filter area compared with the conventional separate filters illustrated in FIG. 1. More specifically, one can minimize the amount by which is reduced by framed attached to the periphery of the filter. Accordingly, a filter with a large effective filtering area can be obtained, and the filtered air can be use as a dust-removing air flow without any of the special difficulties which often occur in conventional devices.

As described above, according to the present invention, an improved open-end spinning machine can be provided by which occurrence of irregular yarns can completely be prevented, yarn breakage can remarkably be decreased, deposition of floating fibers on various portions of the spinning unit can be prevented, and troubles concerning checks for filter clogging and cleaning of filters can be minimized so as to facilitate check and cleaning.

We claim:

1. An open-end spinning machine having at least one spinning unit having a feed roller for feeding fibrous material, a combing roller for combing said fibrous material fed thereto by said feed roller, a spinning rotor for spinning the fibrous material combed by said combing roller into a yarn, a combed fibrous material channel extending from the vicinity of said combing roller to the inside of said spinning rotor for delivering said combed fibrous material to said rotor, and a dust removing opening communicating with said combing roller for removing dust from said fibrous material, said spinning machine comprising:

air filtering means disposed adjacent an external surface of said spinning machine for filtering a first stream of inlet air;

a first air passage communicating with said air filtering means, said passage supplying filtered inlet air to said channel and said dust removing opening via passage portions adjacent the upper surface of said feed roller and the upper and lower surfaces of said combing roller, the portion of said passage adjacent the lower surface of said combing roller having a laterally elongated generally elliptical cross-section so as to distribute filtered inlet air over a major portion of the bottom surface of the combing roller; and a second air passage for communicating a second stream of inlet air to a region communicating with said dust removing opening, to transport the dust removed from said fibrous material via said dust removing opening.

2. The spinning machine according to claim 1, wherein said second stream of inlet air is unfiltered.

3. An open-end spinning machine according to claim 1, which further comprises a detecting means, disposed in said first air passage, for detecting changes in air flow passing through said first air passage, and an indicating means for indicating the occurrence of an abnormal condition by receiving a signal from said detecting means.

4. An open-end spinning machine according to claim 3, wherein said indicating means is an alarm.

5. An open-end spinning machine according to claim 3, wherein said first air passage includes a plurality of branches and all of said branches have said detecting means.

6. An open-end spinning machine according to claim 3, wherein said detecting means is a device for measuring static pressure.

7. An open-end spinning machine according to claim 3, wherein said detecting means is a sensor for detecting temperature.

8. An open-end spinning machine according to claim 3, wherein said detecting means is a hot-wire anemometer.

9. An open-end spinning machine having at least one spinning unit having a feed roller for feeding fibrous material, a combing roller for combing said fibrous material fed thereto by said feed roller, a spinning rotor for spinning the fibrous material combed by said combing roller into a yarn, a combed fibrous material channel extending from the vicinity of said combing roller to the inside of said spinning rotor for delivering said combed fibrous material to said rotor, and a dust removing opening communicating with said combing roller for removing dust from said fibrous material, said spinning machine comprising:

an air passage supplying air to said channel and said dust removing opening via passage portions adjacent the upper surface of said feed roller and the upper and lower surfaces of said combing roller, the portion of said passage adjacent the lower surface of said combing roller having a laterally elongated generally elliptical cross-section so as to distribute air over a major portion of the bottom surface of the combing roller.

10. An open end spinning machine having at least one spinning unit having a feed roller for feeding fibrous material, a combing roller for combing said fibrous material fed thereto by said feed roller, a spinning rotor for spinning the fibrous material combed by said combing roller into a yarn, a combined fibrous material channel extending from the vicinity of said combing roller to the inside of said spinning rotor for delivering said combed fibrous material to said rotor, and a dust removing opening communicating with said combing roller for removing dust from said fibrous material, said spinning machine comprising:

at least an air passage supplying air to at least a predetermined portion within said spinning unit; and at least a detecting means, disposed in said air passage, for detecting changes in air flow passing through said air passage and an indicating means for indicating the occurrence of an abnormal condition by receiving a signal from said detecting means.

* * * * *